US006588034B2

(12) United States Patent
Nation

(10) Patent No.: US 6,588,034 B2
(45) **Date of Patent: *Jul. 8, 2003**

(54) MATERNITY BEACH CHAIR

(76) Inventor: Shannon I. Nation, 823 Churchill Ter., Hampton, VA (US) 23666

( * ) Notice: Subject to any disclaimer, the term of this patent is extended or adjusted under 35 U.S.C. 154(b) by 0 days.

This patent is subject to a terminal disclaimer.

(21) Appl. No.: 10/101,635

(22) Filed: Mar. 20, 2002

(65) Prior Publication Data

US 2002/0095723 A1 Jul. 25, 2002

Related U.S. Application Data

(63) Continuation-in-part of application No. 09/967,947, filed on Oct. 2, 2001, now abandoned, which is a continuation-in-part of application No. 09/573,674, filed on May 19, 2000, now Pat. No. 6,295,668.

(60) Provisional application No. 60/147,491, filed on Aug. 9, 1999.

(51) Int. Cl.[7] ..... A47C 17/16

(52) U.S. Cl. ..... 5/110; 5/631; 5/930

(58) Field of Search ..... 5/110, 111, 631, 5/930, 725, 646, 638

(56) References Cited

U.S. PATENT DOCUMENTS

| | | | | |
|---|---|---|---|---|
| 1,261,063 A | | 4/1918 | Slater | |
| 1,265,848 A | | 5/1918 | Wheeler | |
| 1,545,882 A | | 7/1925 | Coopersmith | |
| 2,089,854 A | | 8/1937 | Pellegrini | |
| 3,464,069 A | | 9/1969 | Bien | |
| 3,897,102 A | * | 7/1975 | Lemaire | 5/656 |
| 4,508,384 A | | 4/1985 | Castelot et al. | |
| 4,921,301 A | | 5/1990 | Haynes | |
| 4,941,222 A | * | 7/1990 | Prager | 5/111 |
| 5,029,349 A | | 7/1991 | Hamilton | |
| D341,725 S | | 11/1993 | Piper | |
| D343,303 S | | 1/1994 | DiGregorio | |
| 5,339,471 A | | 8/1994 | Lanzara | |
| 5,438,715 A | | 8/1995 | Jackman | |
| 5,829,080 A | | 11/1998 | Robillard et al. | |
| 5,926,871 A | * | 7/1999 | Howard | 5/111 |
| 6,059,365 A | | 5/2000 | Diamond | |
| 6,151,730 A | * | 11/2000 | Weston | 5/110 |
| 6,158,069 A | * | 12/2000 | Boothe | 5/646 |
| 6,295,668 B1 | * | 10/2001 | Nation | 5/110 |

FOREIGN PATENT DOCUMENTS

| | | |
|---|---|---|
| FR | 1079143 | 11/1954 |
| GB | 28590 | 12/1902 |

* cited by examiner

*Primary Examiner*—Michael F. Trettel
(74) *Attorney, Agent, or Firm*—Richard C. Litman

(57) ABSTRACT

A beach chair has a frame, a plurality of leg assemblies, a main frame cover, an auxiliary cover, fasteners for the main frame cover and the auxiliary cover, and two openings within the main frame cover (one for receiving a person's face, the other for receiving a person's abdomen). The frame includes an upper rectangular shaped support main frame having each corner connected to a leg assembly. In use, the beach chair is unfold by pivoting the legs downward from the main frame into locking positions.

8 Claims, 8 Drawing Sheets

MATERNITY BEACH CHAIR

CROSS-REFERENCE TO RELATED APPLICATIONS

This application is a continuation-in-part of application Ser. No. 09/967,947 filed Oct. 2, 2001 and now abandoned, which is a continuation of application Ser. No. 09/573,674 filed May 19, 2000 and now U.S. Pat. No. 6,295,668, which claims the benefit of U.S. Provisional application Serial No. 60/147,491, filed Aug. 9, 1999.

BACKGROUND OF THE INVENTION

1. Field of the Invention

The present invention relates to beach chairs and, more specifically, to a beach chair that is interchangeable for a pregnant woman.

2. Description of Related Art

Numerous types of portable and collapsible beach chairs are known in the art; however, many of these chairs are not comfortable for people with enlarged abdominal areas. U.S. Pat. No. 2,089,854, issued to Mildred Pellegrini on Aug. 10, 1937, describes a maternity cot and mattress. The cot has a rectangular frame with a central opening and a flexible support net which maintains the mattress. The flexible support includes two similar screened sections and is joined by an intermediate canvas. The canvas is sewed into the edges of the rectangular frame. The mattress has a similar central opening which positionally conforms to the central opening of the main frame. The invention also includes a cover that is placed over the opening when a pregnant woman is not lying in prone position.

U.S. Pat. No. 5,438,715, issued to Royd A. Jackman on Aug. 8, 1995, describes a lounger for pregnant women having three frame components. The lounger includes a support pad with a circular recess. A pad cover is dimensioned to be received within the circular recess of the support pad to provide a flat surface. The two patents mentioned above illustrate clumsy and bulky cot/mattress apparatus which a pregnant woman would not want to drag to the beach for sunbathing.

U.S. Pat. No. 3,464,069, issued to Elaine M. Bien on Sep. 2, 1969, describes a portable sunbathing cot. The cot includes an upper bed frame supported at each end corner by a retractable leg assembly having the upper bed frame supporting a horizontally extended cover. The cover is provide with a centrally positioned enlarged opening adapted to receive the abdomen of a person when lying face down on the cot. An additional cover is used to place over the opening in order for the cot to be used in its normal manner. Since a person with a large abdomen has their weight centered towards the middle of their body, this invention may cause problems because there are no legs or reinforcements in the midsection of the cot.

Bars located in the main frame of some of the following patents are positioned directly beneath the main cover which are felt by a person lying on the chair and can be very uncomfortable. U.S. Des. Pat. No. 341,725, issued to Patricia D. Piper on Nov. 30, 1993, illustrates a collapsible maternity lounge chair having two members that fold towards the middle main frame of the chair. The leg members also are collapsible towards the middle main frame. The main frame and the two members are separately covered with a material and the main frame section includes a circular recess that contains an elastic like material for receiving a person's abdomen.

U.S. Des. Pat. No. 343,303, issued to Barbara A. DiGregorio on Jan. 18, 1994, illustrates a maternity lounge chair which is basically the same as the above mentioned patent only this invention has side skirts and the main frame section includes an elastic band to hold the abdomen instead of a circular recess.

U.S. Pat. No. 5,029,349, issued to Valerie Hamilton on Jul. 9, 1991, describes a chair having three support frames. The third support frame is adjustable to the first and second support frame and can be rotational from a horizontal position to a substantially vertical position. The third support frame also includes an adjustable abdomen support longitudinally positioned between its ends for co-operation with cushions positioned on the first and third support frame.

U.S. Pat. No. 4,508,384, issued to Lawrence E. Castelot and Linda A. Castelot on Apr. 2, 1985, describes a lounge chair for a pregnant woman. The chair is made up of a main seat frame with a backrest, a foot rest, and a second seat frame which covers an open area in the main seat frame. The open area contains an adjustable stretch band to support a woman's stomach. A disadvantage to these patents is the spaced apart stretch bands still leave portions of the protruding abdomen uncomfortably exposed and without full support between the webbing portions and stretch bands or even between the tubular elements of the frame. U.S. Pat. No. 4,921,301, issued to R. Jalaine Haynes on May 1, 1990, describes a maternity lounge chair which is basically the same as the previously mentioned patent. However, the upper and lower panels of this invention are formed with a border of firm non-stretching material which act to distribute weight to the elastic stretching material. Also elongated strips join the mid portion of the frame cover to the ends portions for continuous support for a reclining person along the length of the frame and frame cover.

U.S. Pat. No. 5,339,471, issued to Ronald F. Lanzara on Aug. 23, 1994, describes a resting bed for a person with a large abdomen. The resting bed includes a parallel top rails supported above the floor, an upper trunk support sling, and a lower body support sling. Each sling is slidably mounted on the top rails. The slings are spaced from one another to leave an opening for a person's abdomen to be placed. The slings can be adjusted in size to account for the different shapes and sizes of the abdomen. The resting bed also includes an opening in the canvas which permits the user to lie face down on the bed in the prone position. The problem with this invention is that all the user's weight is centered towards the abdomen and would place an incredible amount of stress on the user's back because there is no additional support between the slings.

U.S. Pat. No. 5,829,080, issued to Julie Robillard et al. on Nov. 3, 1998 and U.S. Pat. No. 6,059,365, issued to Penelope J. Diamond on May 9, 2000 disclose lounge chairs having openings for the head or face of a user. The patents do not contemplate providing an opening for the abdomen or for an easily removable cover.

U.S. Pat. No. 1,265,848, issued to Ernest Wheeler on May 14, 1918 is drawn to a folding cot. The cot has no openings in the cover member.

U.S. Pat. No. 1,545,882, issued to Coopersmith on Jul. 14, 1925 and U.S. Pat. No. 1,261,063 issued to Mabel Slater on Apr. 2, 1918 show cots with covers that are attached by removal fasteners. The covers have no openings for the face or abdomen.

British Patent number 28,590 issued in January of 1902 is drawn to a cot or mattress for children.

French Patent number 1,079,143 issued in November of 1954 discloses a convertible chair.

An ideal beach chair could be easily converted from a chair for a pregnant woman or person with a large abdomen into a beach chair for normal use. The beach chair would also include an opening within the chair cover to accommodate a person's face when lying in the prone position so they would not have to twist their neck to their left or right side. The instant invention provides a most suitable answer to the dilemma.

None of the above inventions and patents, taken either singly or in combination, is seen to describe the instant invention as claimed.

SUMMARY OF THE INVENTION

The present invention is a beach chair which can be adapted for a woman who is pregnant and wishes to sunbathe in the prone position. The beach chair comprises a frame means, a plurality of leg assemblies, a main frame cover, an auxiliary cover, fastening means for the main frame cover and auxiliary cover, and two openings within the main frame cover (one for receiving a person's face, the other for receiving a person's abdomen).

The frame means in two of the embodiments includes an upper rectangularly-shaped support main frame having each corner connected to a leg assembly. In use, the beach chair is unfolded by pivoting the legs downward from the main frame into locking position, as is commonly known in the art. The main frame cover is also divided into three unseparated sections which equally conform to the three sections of the main frame.

The first section of the main frame in the two embodiments comprises a facial opening dimensioned and configured to receive the face of the user when lying in the prone position. The second section of the first embodiment of the main frame cover contains an opening dimensioned and configured to receive a person's abdomen. The abdominal opening includes a support pouch dimensioned and configured to fit within the opening and comprised of a stretchy material which is dimensioned and configured to conform to a person's abdomen.

The auxiliary cover for the maternity beach chair is made of the same material as the main frame cover, when stretched over the enlarged abdominal opening, appears like the second embodiment of the beach chair. The second embodiment of the beach chair does not include an abdominal opening in the second section of the main frame cover and remains as a continuous sheet of material. However, both embodiments comprise a facial opening located in the first section of the main frame cover. Each example of the beach chair includes a handle and a shoulder strap.

Third and fourth embodiments incorporate arm rests and an adjustable back wherein the portable structure functions as a lounge chair.

Accordingly, it is a principal object of the invention to provide a new and foldable maternity beach chair which comfortably supports a pregnant woman in prone position lying on her stomach.

It is a further object of the invention to provide a new and foldable beach chair which comfortably supports a large person's abdomen in prone position when lying on his/her stomach.

Still another object of the invention is to provide a beach chair which accommodates the bulge of the abdomen with continuity of support between the accommodating portion and firm non-stretching material portions on all sides.

A further object of the invention is to provide a foldable structure in the form of a lounge chair which comfortably supports a pregnant women.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
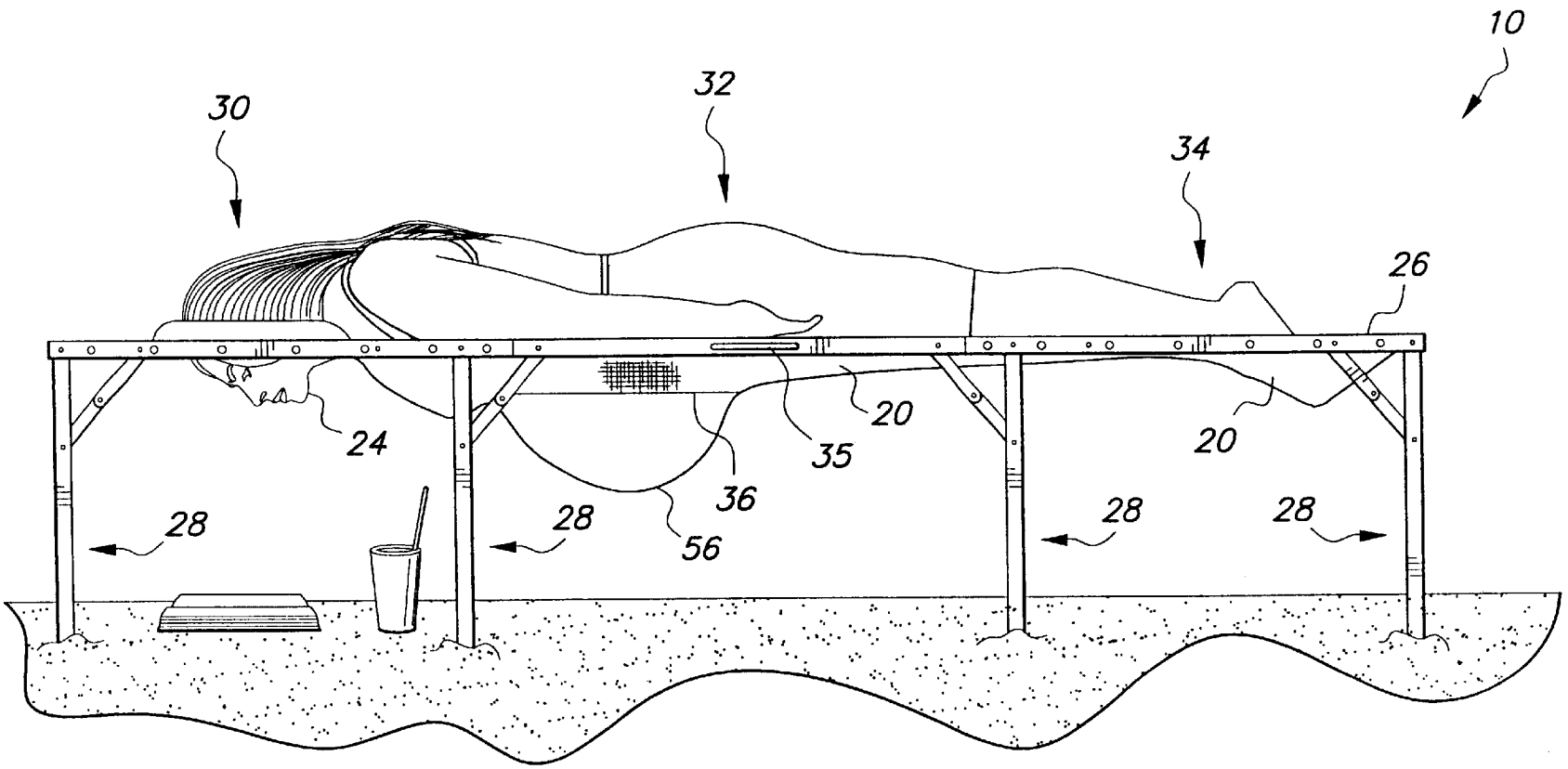
FIG. 1 is an environmental, perspective view of a maternity beach chair according to the present invention.

The present invention is a maternity beach chair for sunbathing designated as 10 in the drawings. The beach chair comprises a frame means, a plurality of leg assemblies, a main frame cover, an auxiliary cover, fastening means for main frame cover and auxiliary cover, two openings within the main frame cover (one for receiving a person's face, the other for receiving a person's abdomen), a handle and a shoulder strap.

Figure 5:
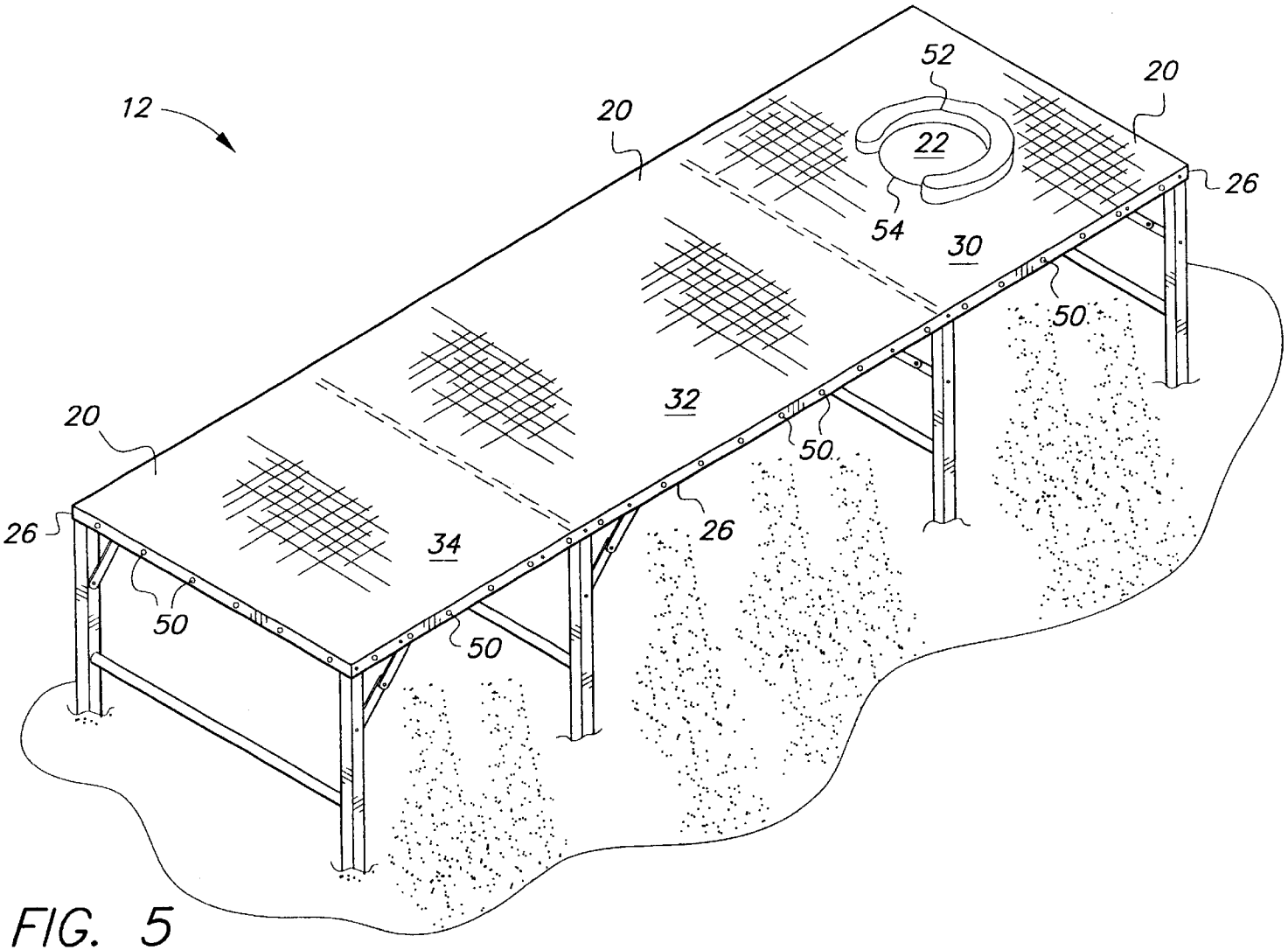
FIG. 5 is a plan view of a further example of a beach chair of the present invention.

The beach chairs 10 (FIG. 1) and 12 (FIG. 5) have two embodiments where the main frame cover 20 is adapted to accommodate certain people in a different way. The first embodiment 10 shown in FIG. 1 is referred to as the "maternity beach chair" 10, and is specifically dimensioned for a person who is either pregnant or has a large abdomen. The second embodiment 12 shown in FIG. 5 is for a normal sized person. The main frame cover 20 in both embodiments 10 and 12 includes an opening 22 specifically dimensioned to receive a person's face 24.

Figure 2:
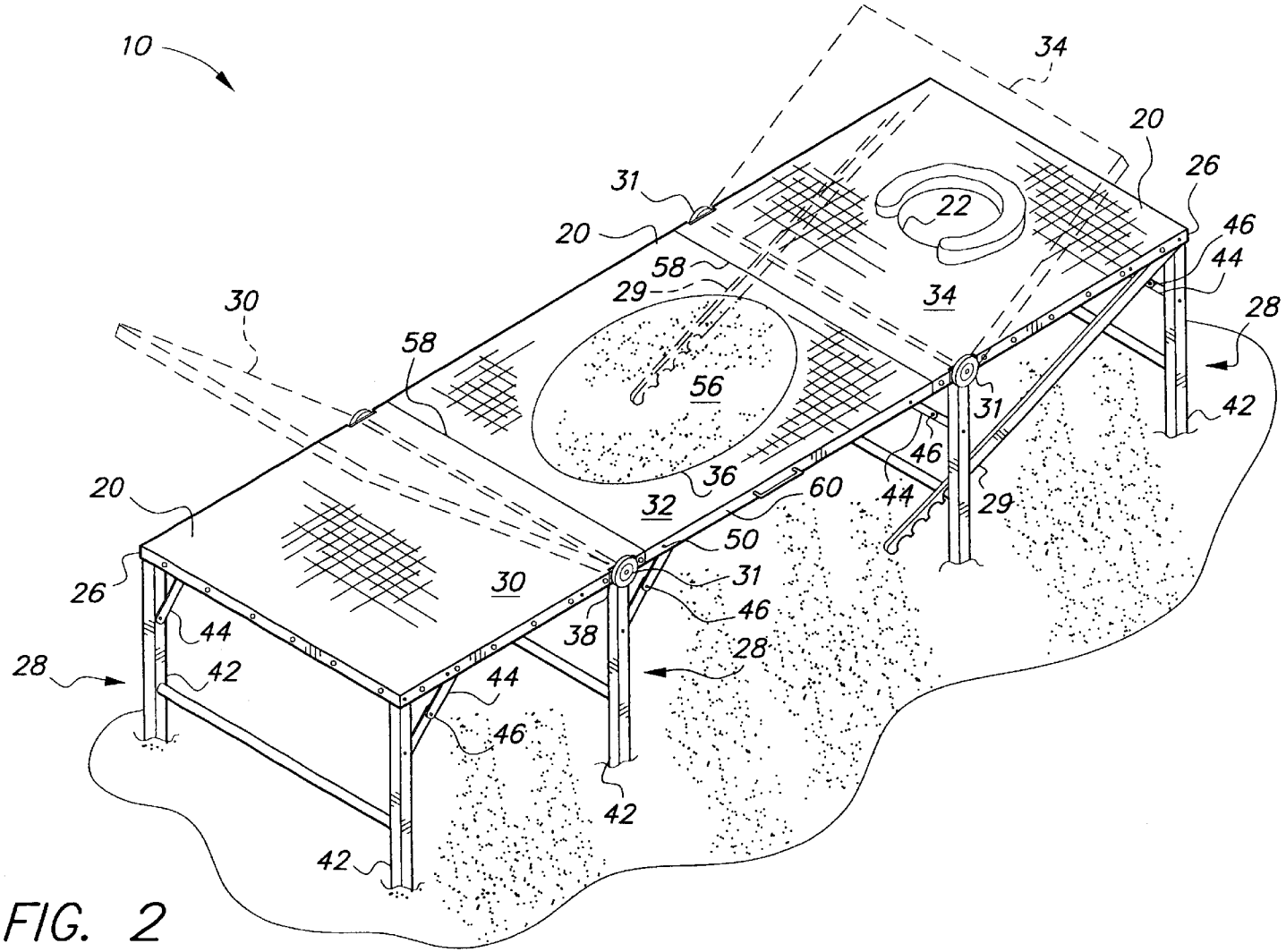
FIG. 2 is a plan view of a maternity beach chair of the present invention.

FIG. 1 shows the frame means in both embodiments 10 and 12 which includes an upper rectangular shaped support main frame 26 having each corner connected to a leg assembly 28. The beach chair includes a handle 35 which is securely attached to the main frame 26. The beach chair also includes a shoulder strap (not shown) which is attached to the main frame 26. Any shoulder strap that is standard in the art can be utilized. FIG. 2 shows the entire main. frame 26 is divided into three joined sections. The first section 30 includes an opening 22 for the user's head, the third section 34 supports the user's legs, and the second section 32 is located between the first 30 and third 34 section, and may or may not include the opening 36 for the user's abdomen.

The first 30 and third sections 34 each include an adjustable hinge means 31 for adjusting the first 30 and third 34 sections of the beach chair 10 to pivot in an upright or downright position. The preferred adjustable hinge means 31 comprises a hinge with positioning gears for setting and fixing the desired angles of the first 30 and third 34 sections for use in the open position. Hinge means 31 are well known in the art and form no part of the invention per se.

Another hinging means includes adjustable elevator arms 29. The elevator arms 29 hook onto the bar frame of a leg assembly 28. All examples 10 and 12 of the beach chair may include a plurality of adjustable hinge means 31 that are commonly known in the art. Each adjustable hinge means 31 will be collapsible for transporting and storage.

Figure 3:
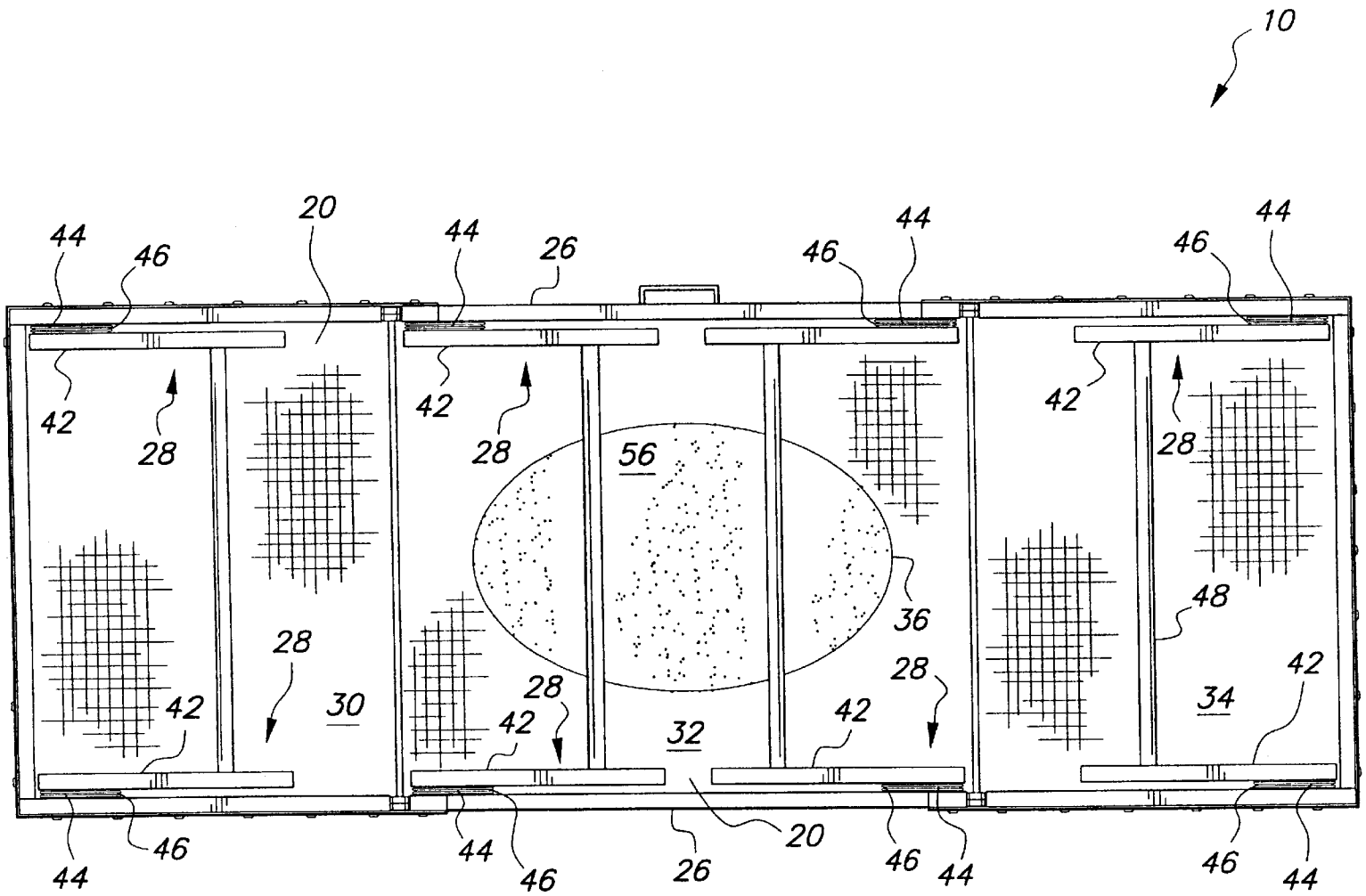
FIG. 3 is a bottom view of a maternity beach chair of the present invention.

The collapsible strut members 44 includes a mid-portion 46 pivotally interconnected. FIG. 3 shows the strut members 44 pushed at the mid-portion 46 towards the leg member 42 where the strut members 44 are rotated to allow the leg members 44 to be folded inward toward the second section 32 of the main frame 26. As the leg assemblies 28 are unfolded, the mid-portion 46 of the strut members 44 are pulled away from the leg member 42 to lock the strut member 44 in place, and prevent the leg member 42 from accidental folding. In use, the beach chair 10 and 12 are unfolded by pivoting the leg assemblies 28 downward from the main frame 26 into locking position, as is common in the art. Each leg member 42 also is supported by a laterally extended support bar 48.

Figure 4:
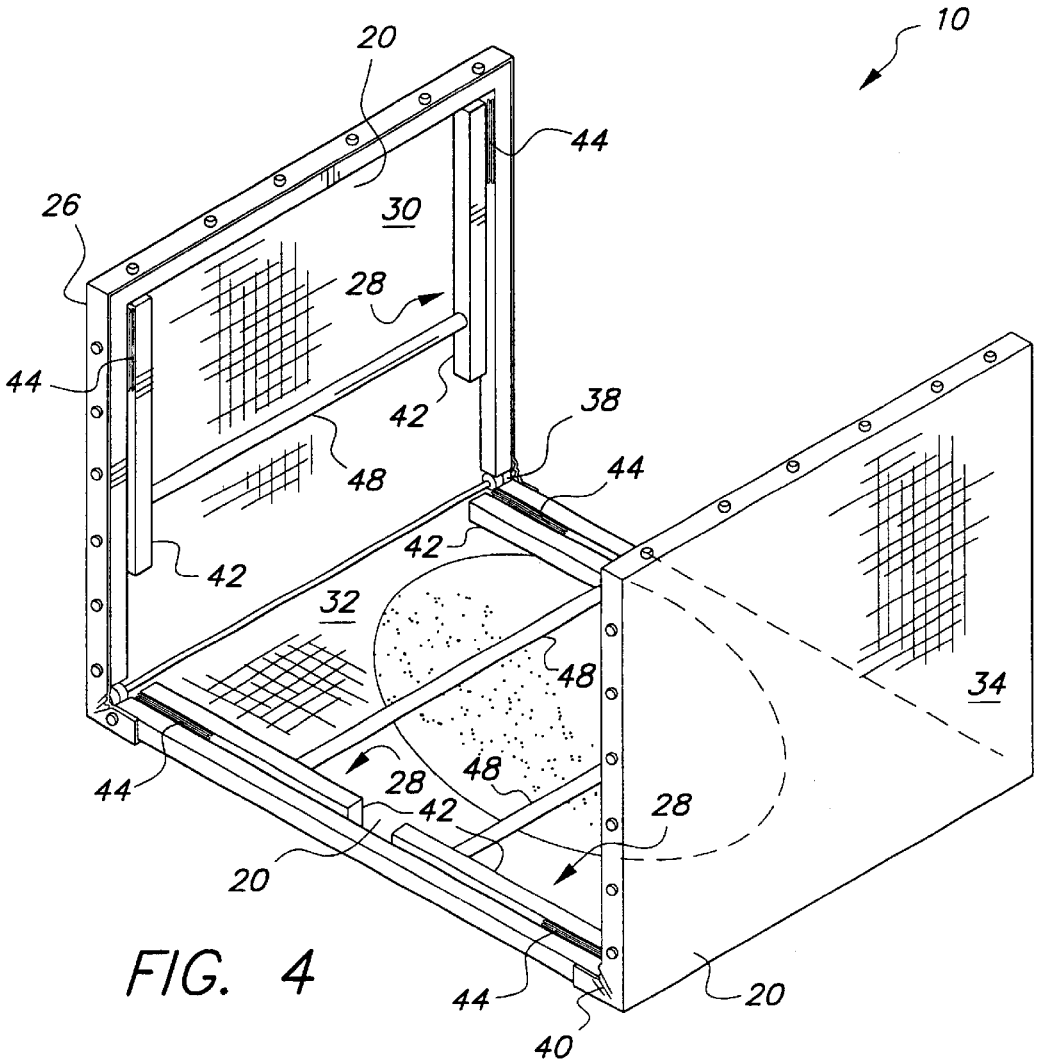
FIG. 4 is a perspective view of a maternity beach chair of the present invention.

FIG. 4 shows how the entire main frame 26 is down and inwardly collapsible in two places 38 and 40. Both places 38 and 40 are located above the leg assemblies 28 within the second section 32 of the main frame 32. The first 30 and third 34 sections pivot away from the second section 32 and stop when the entire main frame 26 is horizontally positioned to the ground's surface. The main frame 26 and leg assemblies 28 are maintained to unfold in an elongated position above the ground's surface. Each leg assembly 28 is located at the ends of the main frame 26 as well as two leg assemblies 28 strategically positioned 38 and 40 to support extra weight towards the second section 32 of the main frame 26. Each leg assembly 28 is provided with a leg member 42 held in an upright position by conventional collapsible strut members 44.

FIG. 5 shows the main frame 26, and in both embodiments 10 and 12 that includes a main frame cover 20 which comprises an enlarged main body and extends across the entire opening of the main frame 26 and held in place by a fastening means. The main frame cover 20 is one continuous surface comprising a sheet of material for supporting a person lying down. The firm non-stretching material distributes weight and stress across the entire main frame cover 20. The main frame cover 20 is also divided into three unseparated sections 30, 32, and 34 which equally conform to the three sections 30, 32, and 34 of the main frame 26.

The main frame cover 20 in both embodiments 10 and 12 further comprises a plurality of detachable fastening means so that the tension of the canvas can be adjusted or removed. The preferred fastening means would be and not limited to fastening button snap members 50. However, the fastening means could be tied onto the main frame 26 or attached by such hook and loop fasteners as VELCRO™. The main frame cover 20 is provided with a plurality of fastener or snap members 50 aligned on the edge of the main cover 20 and dimensioned and configured to engageably correspond with the fastener or snap members 50 on the main frame 26.

The first section 30 of the main frame 26 in both embodiments 10 and 12 comprises a facial opening 22 dimensioned and configured to receive the face 24 of the user. The facial opening 22 comprising an outer 52 and inner 54 half. The facial opening 22 permits the user to lie in a prone position with their face portion 24 of their head to comfortably rest in the facial opening 22 and permit the user to rest in a relaxed breathing position. The facial opening 22 also permits the user to comfortably read a book or novel while sunbathing. When sunbathing most people have to twist their head to the right or left in order to rest in the prone position and find it very uncomfortable. Often, creating painful neck cramps and the end of the day that may last for weeks. However, this problem is eliminated by providing a facial opening 22 within the first section 30 of both embodiments 10 and 12.

FIG. 2 shows the first embodiment 10 of the maternity beach chair which is dimensioned and configured to accommodate either a pregnant women or a person with a large abdominal area. The second section 32 of the first embodiment 10 of the main frame cover 20 contains an opening 36 dimensioned and configured to receive a person's abdomen. The abdominal opening 36 includes a support pouch 56 dimensioned and configured to fit within the opening 36 and comprised of a stretchy material which is dimensioned and configured to conform to a person's abdomen. The opening 36 for the abdomen is enclosed with a stretchy material that expands to conform to the size and shape of a person's abdomen and its elastic is suitable enough to conform to the abdomen of a pregnant woman throughout her nine months of pregnancy.

The first embodiment 10 of the maternity beach chair can be further adapted to accommodate a person who is pregnant and changes her reclining position from lying in the prone position to lying on their back. This is accomplished by including an auxiliary cover 58 which is attached to one side of the beach chair main frame 26 and extendable across the main frame 26 and attached to the opposite side to cover the abdominal opening 36 dimensioned and configured to receive a person's abdomen. The auxiliary cover 58 for the maternity beach chair 10 is made of the same material as the main frame cover 20, when stretched over the enlarged abdominal opening 36, appears like the second embodiment 12 of the beach chair.

In order to provide a removable auxiliary cover 58 the overlapping tab portions 60 at the sides may be fitted with fastening snaps 50 in that the auxiliary cover 58 is removable and replaceable. For converting the maternity beach chair 10 for general use the auxiliary cover 58 is provided with fold over tabs 60 fitted with complementary fastening snaps 50 to secure the auxiliary cover 58 to the main frame cover fastening snaps 50. The second section 32 of the main frame cover 20 comprise double-sided fastening snaps 50 which are dimensioned and configured to couple with the complementary fastening snaps 50 on the overlapping tab portions 60 of the auxiliary cover 58. Both the main frame cover 20 and auxiliary cover 58 may be unsnapped from the main frame 26 to be cleaned and reattached.

In FIG. 5, the second embodiment 12 of the beach chair does not include an abdominal opening 36 in the second section 32 of the main frame cover 20 and remains as a continuous sheet of material. However, both embodiments 10 and 12 comprise a facial opening 22 located in the first section 30 of the main frame cover 20. The beach chair 10 shown in FIG. 1 comprising the support pouch 56 can be detachably removed and reattached for cleaning purposes. The entire main frame cover 20 may also be released and brought underneath the entire main frame 26 for cleaning.

The maternity beach chair 10 can be used in several ways. First, the beach chair 10 can be used in the manner as the second embodiment 12 mentioned earlier by placing the auxiliary cover 58 over the abdominal opening 36 so a normal person may sun bathe. Second, the maternity beach chair 10 can be adapted for a pregnant woman by removing the auxiliary cover 58 which reveals the abdominal opening 36 dimensioned and configured to receive her enlarged belly. Third, the beach chair 10 can be used by any person's who has a delicate injury or an enlarged abdomen in the same manner as the pregnant women.

Both embodiments 10 and 12 are readily collapsible for transport and light weight too. The beach chairs will be economical to manufacture, simple to assemble, and compact for storage and transportation.

Figure 6:
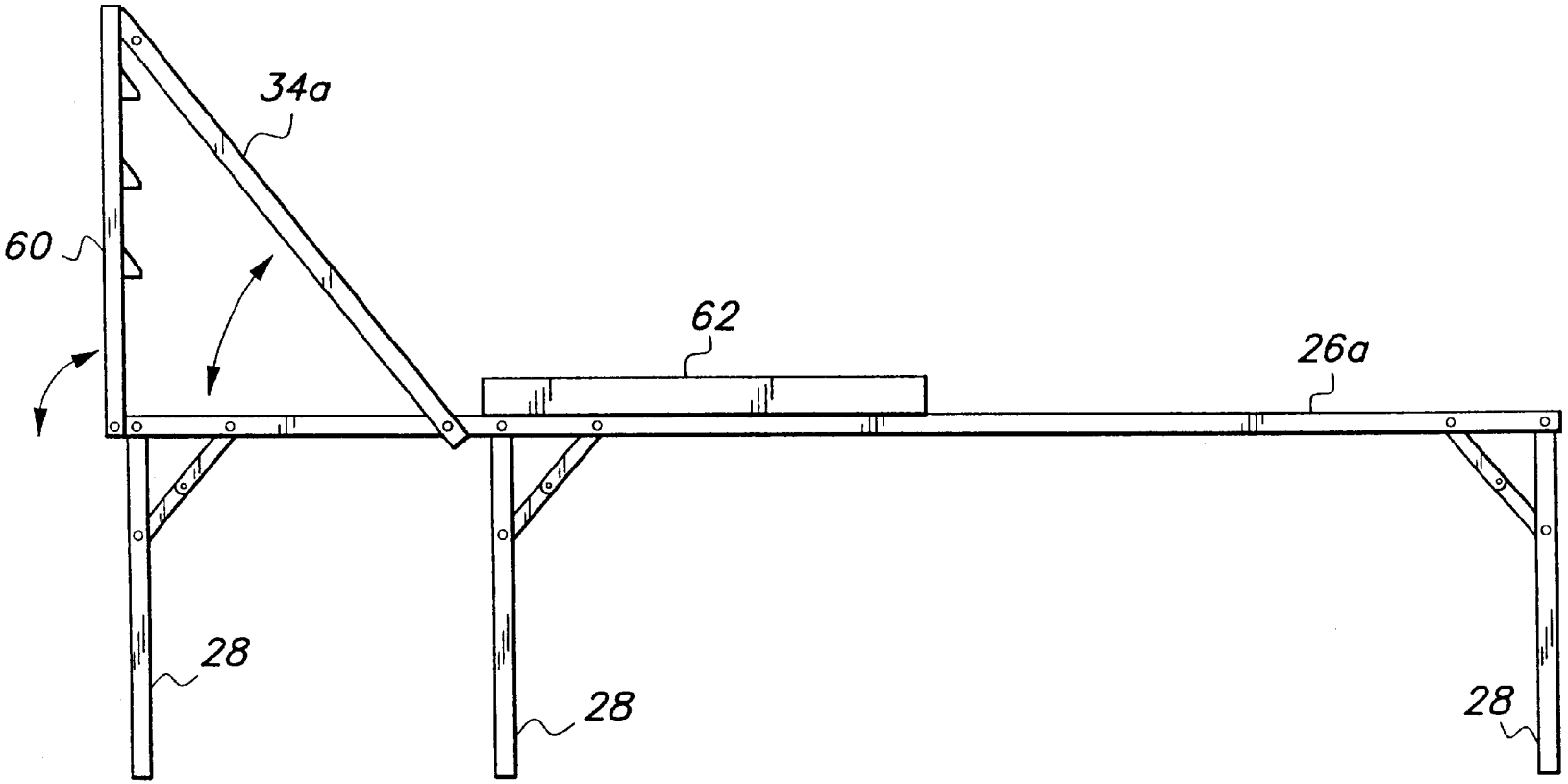
FIG. 6 is a side view of a maternity lounge chair according to the present invention.
Figure 7:
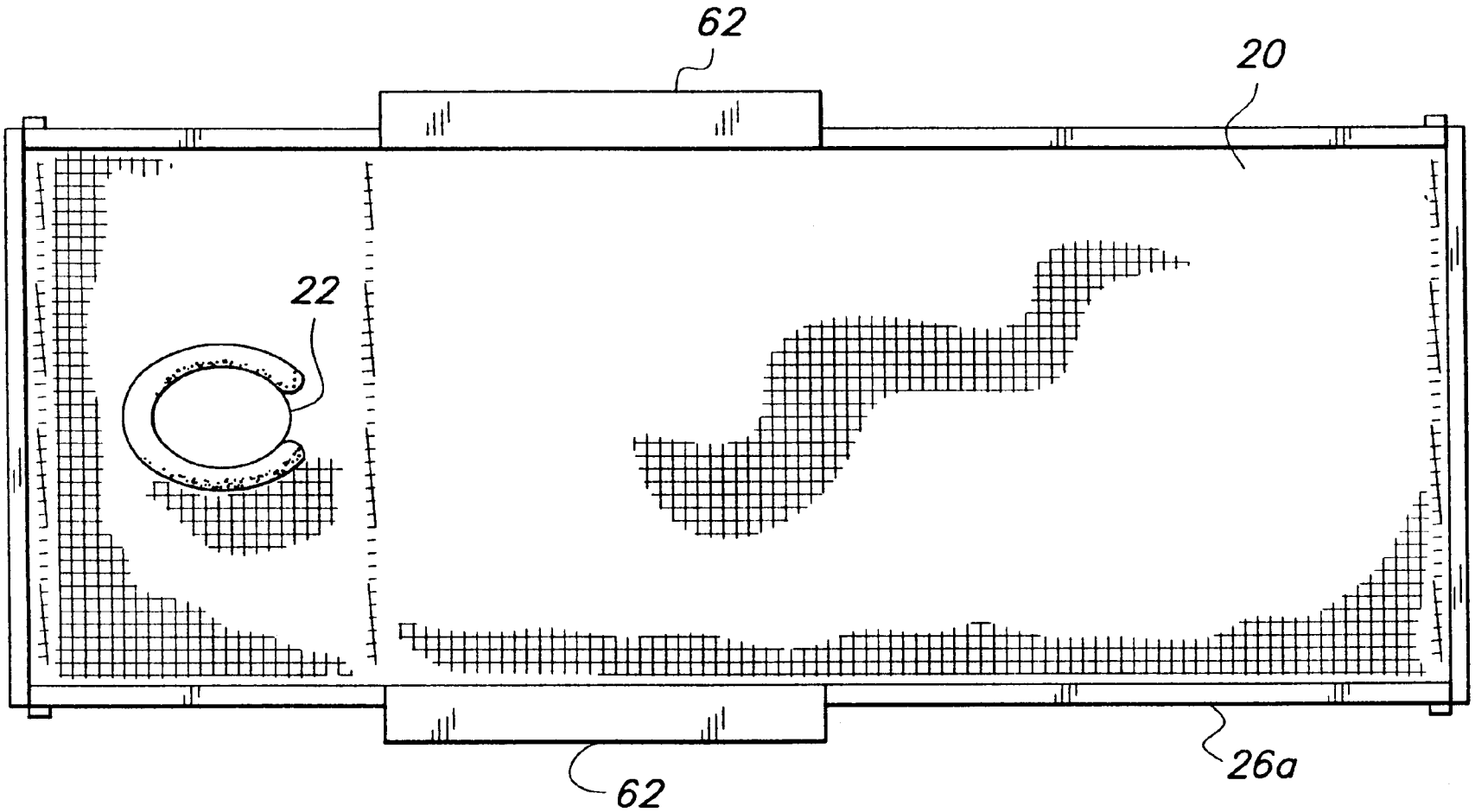
FIG. 7 is a top view of a maternity lounge chair according to the present invention.
Figure 8:
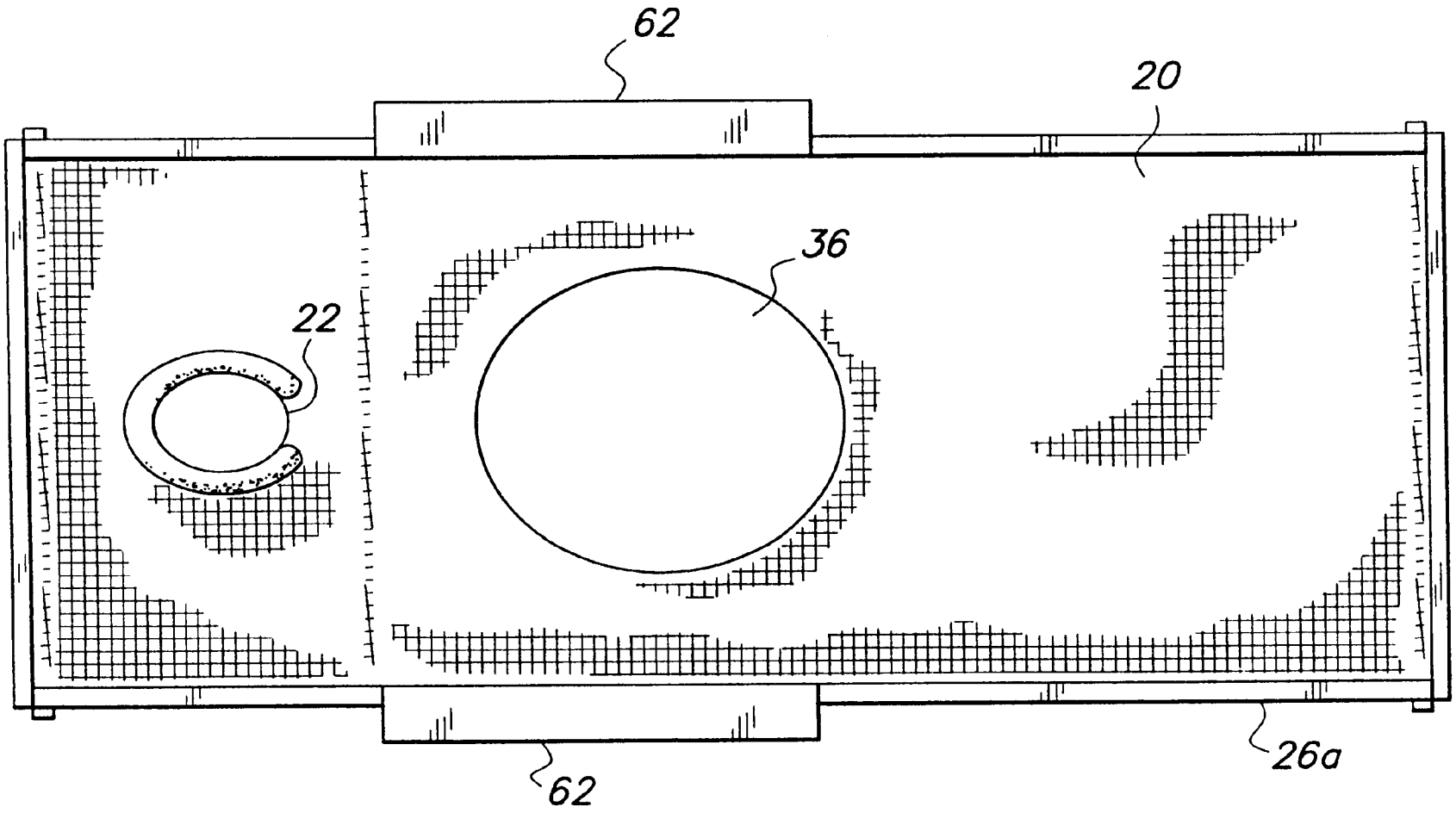
FIG. 8 is a top view of a second embodiment of a maternity lounge chair according to the present invention.

The maternity lounge chair of FIGS. 6–8 comprises only three sets of foldable legs 28 mounted, identically as described in the above embodiments, to a rectangular frame 26*a*. Main frame cover 20 is adapted to cover the frame 26*a* and is attached thereto as described above. The maternity lounge chair is also provided with a pouch and auxiliary cover. Rectangular frame 26*a* differs from frame 26 in that there is only a single section 34*a* pivoted to the frame. A pair of hinged support bars (only one is shown) 60 are pivotally attached to the frame to support section 34*a* in a variety of raised positions. A pair of arm rests 62 are positioned on each side of the frame. As with the beach chair, the lounge chair may be constructed with a single padded facial opening 22 (FIG. 7) or with both facial and abdominal openings 22, 36 (FIG. 8).

It is to be understood that the present invention is not limited to the embodiments described above, but encompasses any and all embodiments within the scope of the following claims.

I claim:

1. A maternity lounge chair comprising:

a rectangularly-shaped frame member, said frame member including a first section and a second section, each section having respective first and second ends;

a first pair of hinges, said first pair of hinges disposed to connect the second end of said first section to the first end of said second section in abutting relationship;

a first pair of collapsible leg members, said first pair of collapsible leg members being pivotally attached to said frame member adjacent the first end of said first section;

a second pair of collapsible leg members, said second pair of collapsible leg members being pivotally attached to said frame member adjacent said first pair of hinges;

a third pair of collapsible leg members, said third pair of collapsible leg members being pivotally attached to said frame member adjacent said second end of said second section;

a cover, said cover being coextensive with said frame member and spanning said frame member whereby to form a planar surface;

means for removably fastening said cover to said frame member;

a first opening formed through said cover at said second section, said first opening having a periphery and dimensioned to receive a face of a user;

a padding positioned on said cover, said padding arranged adjacent a portion of the periphery of said first opening; and a support bar pivotally attached to said frame at said second end of said second section said support bar adapted to support said second section in an inclined position.

2. The maternity lounge chair as recited in claim 1, including a pair of arm rests, said armrests disposed on said frame adjacent said first end of said second section.

3. The maternity lounge chair as recited in claim 2, wherein said means for removably fastening said cover is selected from the group consisting of hook and loop fasteners and ties.

4. A maternity lounge chair comprising:

a rectangularly-shaped frame member, said frame member including a first section and a second section, each section having respective first and second ends;

a first pair of hinges, said first pair of hinges disposed to connect the second end of said first section to the first end of said second section in abutting relationship;

a first pair of collapsible leg members, said first pair of collapsible leg members being pivotally attached to said frame member adjacent the first end of said first section;

a second pair of collapsible leg members, said second pair of collapsible leg members being pivotally attached to said frame member adjacent said first pair of hinges;

a third pair of collapsible leg members, said third pair of collapsible leg members being pivotally attached to said frame member adjacent said second end of said second section;

a cover, said cover being coextensive with said frame member and spanning said frame member whereby to form a planar surface;

means for removably fastening said cover to said frame member;

a first opening formed through said cover at said second section, said first opening having a periphery and dimensioned to receive a face of a user;

a padding positioned on said cover, said padding arranged adjacent a portion of the periphery of said first opening;

second opening formed through said cover at said first section, said second opening having a periphery and dimensioned to receive an abdominal area of a user;

a support pouch spanning said second opening and attached along the periphery of said second opening; and a support bar pivotally attached to said frame at said second end of said second section said support bar adapted to support said second section in an inclined position.

5. The maternity lounge chair as recited in claim 4, including a pair of arm rests, said armrests disposed on said frame adjacent said first end of said second section.

6. The maternity lounge chair as recited in claim 5, including an auxiliary cover, said auxiliary cover adapted to be disposed to cover said second opening; and second means for removably fastening said auxiliary cover to said frame member.

7. The maternity lounge chair as recited in claim 6, wherein said means for removably fastening said cover is selected from the group consisting of hook and loop fasteners and ties.

8. The maternity beach chair as recited in claim 7, wherein said second means for removably fastening said auxiliary cover is selected from the group consisting of hook and loop fasteners and ties.

* * * * *